US011524868B2

(12) United States Patent
Shah

(10) Patent No.: US 11,524,868 B2
(45) Date of Patent: Dec. 13, 2022

(54) METHOD AND APPARATUS FOR EFFECTIVELY UTILIZING CAB SPACE

(71) Applicant: Otis Elevator Company, Farmington, CT (US)

(72) Inventor: Mahesh N. Shah, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1036 days.

(21) Appl. No.: 16/217,770

(22) Filed: Dec. 12, 2018

(65) Prior Publication Data

US 2019/0177121 A1 Jun. 13, 2019

(30) Foreign Application Priority Data

Dec. 12, 2017 (IN) ..... 201711044638

(51) Int. Cl.
*B66B 3/00* (2006.01)
*B66B 5/00* (2006.01)
*B66B 1/34* (2006.01)

(52) U.S. Cl.
CPC ..... *B66B 5/0012* (2013.01); *B66B 1/3476* (2013.01); *B66B 3/002* (2013.01)

(58) Field of Classification Search
CPC ..... B66B 3/00; B66B 3/006; G06F 3/147
See application file for complete search history.

(56) References Cited

U.S. PATENT DOCUMENTS 5,258,586 A 11/1993 Suzuki et al.
5,329,076 A 7/1994 Kameli
5,490,580 A 2/1996 Powell et al.
6,339,375 B1 * 1/2002 Hirata ..... G01V 8/10 340/541
7,140,469 B2 11/2006 Deplazes et al.
7,712,586 B2 5/2010 Legez
8,020,672 B2 9/2011 Lin et al.
8,660,700 B2 2/2014 Jia et al.
8,960,373 B2 2/2015 De Vincentis
(Continued)

FOREIGN PATENT DOCUMENTS

CN 104229575 A 12/2014
CN 104276468 A 1/2015
(Continued)

OTHER PUBLICATIONS

Chinese Office Action for application CN 2018115110678.9, dated Apr. 3, 2020, 5 pages.
(Continued)

*Primary Examiner* — Daniel Abebe
(74) *Attorney, Agent, or Firm* — Cantor Colburn LLP

(57) ABSTRACT

A method and a system for efficiently managing space inside an elevator cab is described. The system comprises a camera system, an image processing unit, a processing unit, and a display unit. The system processes the image captured by the camera system comprising images of the occupants including passengers and objects inside the elevator. The captured image is transferred to the image processing unit. The image processing unit processes the image for further evaluation by the processing unit. The processing unit provides possible rearrangement of the passengers and the objects (occupants) to be rendered by the display unit.

14 Claims, 5 Drawing Sheets

(56) References Cited

U.S. PATENT DOCUMENTS

| | | | | |
|---|---|---|---|---|
| 2004/0179736 | A1 | 9/2004 | Yin et al. | |
| 2016/0289042 | A1 | 10/2016 | Fang et al. | |
| 2016/0311646 | A1* | 10/2016 | Bryant | B66B 1/468 |
| 2016/0311648 | A1* | 10/2016 | Vaarala | B66B 19/002 |
| 2018/0111787 | A1* | 4/2018 | Patel | B66B 1/2458 |
| 2018/0273346 | A1* | 9/2018 | Hwang | B66B 5/0012 |
| 2019/0016557 | A1* | 1/2019 | Baldi | B66B 1/2458 |
| 2019/0139254 | A1* | 5/2019 | Mochizuki | G06Q 10/043 |
| 2019/0144238 | A1* | 5/2019 | Osawa | B66B 1/3476 187/387 |

FOREIGN PATENT DOCUMENTS

| | | | |
|---|---|---|---|
| CN | 106185494 | A | 12/2016 |
| CN | 106276435 | A | 1/2017 |
| CN | 106966277 | A | 7/2017 |
| CN | 107128763 | A | 9/2017 |
| CN | 107176535 | A | 9/2017 |
| EP | 1313321 | A1 | 5/2003 |
| EP | 1345445 | A1 | 9/2003 |
| JP | 2011057322 | A | 3/2011 |
| JP | 2012180190 | A | 9/2012 |
| JP | 2013025599 | A | 2/2013 |
| JP | 2013056751 | A | 3/2013 |
| JP | 2014189338 | A | 10/2014 |
| JP | 2016193772 | A | 11/2016 |

OTHER PUBLICATIONS

European Search Report for application 18211430.6, dated May 15, 2019, 80 pages.

* cited by examiner

METHOD AND APPARATUS FOR EFFECTIVELY UTILIZING CAB SPACE

FOREIGN PRIORITY

This application claims priority to Indian Patent Application No. 201711044638, filed Dec. 12, 2017, and all the benefits accruing therefrom under 35 U.S.C. § 119, the contents of which in its entirety are herein incorporated by reference

TECHNICAL FIELD OF INVENTION

The invention relates to the elevator systems, and in various embodiments, towards effective utilization of elevator cab space.

BACKGROUND OF THE INVENTION

Many a times cab space inside elevators is not utilized effectively, especially when there is a large passenger movement at crowded places e.g. shopping malls, commercial buildings, office premises etc. There are multiple instances where many passengers are waiting for an elevator cab and only few can get inside the elevator cab when the elevator cab arrives while other passengers are waiting outside even though the elevator cab can accommodate more passengers inside. This results in more waiting time for the waiting passengers which in turn results in frustration. This could happen when the passengers inside the elevator cab are not properly organized.

Moreover it happens many times that the passengers inside the elevator cab stand near the door area. This creates an impression that the elevator cab is full when in reality the back side of elevator cab is empty. Due to this, the passengers waiting outside the elevator cab to board the elevator cab are of the impression that the elevator cab is full and the waiting passengers would not try to get inside the elevator cab.

However, if the passengers inside the elevator cab are organized properly, the elevator cab would be in a position to accommodate more people at the same time.

In the existing art, camera systems are used for monitoring passengers inside the elevator cab for authenticity and to detect the crowd level inside the elevator cab. However, these systems do not provide any inputs to control the objects and passengers inside the elevator cab.

Moreover, the existing arts describe the use of camera system to monitor passengers inside the elevator cab. In such systems image of the passengers is captured which is used to display the arrangement of passengers on a LED display inside the elevator cab. Most of the existing literature uses load cells to determine the position of the passengers. The use of the load cells have the disadvantage as the actual space of occupancy is not accurately determined. For example, if the luggage of the passenger is lifted by the passenger the information regarding the occupancy of the elevator cab would not be accurate.

Therefore, there is a need in the art to provide improved method and system to assist the passengers/objects (occupants) in rearrangement inside the elevator. There is a need to efficiently utilize the space inside the elevator cab.

OBJECTIVES OF THE INVENTION

Thus, it is the object of the present invention to provide improved system and method to assist the passengers in rearrangement to efficiently utilize the elevator cab space.

Another object of this invention is to assist the passengers outside the elevator cab in hall area to get efficiently accommodated inside the elevator cab.

Yet another object of the invention is to reduce the power consumption and maintenance of the elevator cab.

Yet another object of the invention is to provide an intelligent system to reduce the inconvenience to the passengers at places with huge passenger movement.

SUMMARY OF THE INVENTION

To achieve the outlined objectives and to overcome the deficiencies and drawbacks of the existing art, the present invention discloses an elevator system for efficiently managing space inside an elevator. The system includes a camera system for acquiring image data of the passengers and objects (occupants) inside the elevator. An image processing unit of the system is used to process the image data acquired by the camera system to generate occupants' information. A central processing unit of the system is used for receiving the occupants' information with the processed image data and rearranging the image data based on the occupants' information determined by the image processing unit and a first display unit to display the rearranged data of the passengers and objects of the image data.

In another embodiment, the image processing unit determines the passenger and object (occupant) information by processing the image data. The passenger and object information include total available space and occupied space inside the elevator and facial recognition of each passenger inside the elevator. In yet another embodiment, the passenger and object information includes determining relative position of each passenger and object inside the elevator. The image processing unit processes the passenger and object (occupants) information including the length, width, radius and area occupied by each passenger and object. Based on the processed passenger and object information a cab master image is generated by the image processing unit which is further provided to the central processing unit.

In another embodiment of the invention, the camera system is used to acquire image data based on one or more cameras including three dimensional (3D) cameras. The one or more cameras are installed on rooftop of the elevator and on different walls of the elevator to cover different viewpoints. In yet another embodiment, image data is captured as static image as well as in the form of a video stream. The input image data can be processed in a color, grayscale or other available image formats.

In yet another embodiment, based on the passenger and object information and the cab master image received from the image processing unit, the central processing unit rearrangement of the passengers and objects displayed on the first display unit. In another embodiment, the rearrangement of the passengers displayed on the first display unit can be based on the destination floor of the passengers. In yet another embodiment, the rearrangement of the passengers and objects displayed on the first display unit can be based on area occupied by each passenger and object inside the elevator. In still another embodiment, the rearrangement of the passengers displayed on the first display unit can be in the form of a video stream showing rearrangement of the passengers and objects inside the elevator.

In still another embodiment of the invention, a camera system is used for acquiring first image data of occupants inside the elevator and a second image data of passengers waiting outside the elevator in a hall area. An image processing unit for processing the first image data to generate first information related to each of the occupants and creating a cab master image and to generate a second information related to the passengers in the hall area and creating a hall master image. A processing unit for receiving the cab master image and the hall master image from the image processing unit and rearranging the image data based on the cab master image and the hall master image to accommodate passengers in the hall area. An audio unit receiving information from the processing unit based on rearranged image data to announce the accommodation of passengers from the hall area.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Described herein are techniques for systems, methods, and devices for providing efficient utilization of the elevator cab space by providing appropriate rearrangement of passengers and objects inside the elevator cab. The rearrangement is based on real time parameters available during operation of the elevator cab. In the following description, for purposes of explanation, examples and specific details are set forth in order to provide a thorough understanding of particular embodiments. Particular embodiments as defined by the claims may include some or all of the features in these examples alone or in combination with other features described below, and may further include modifications and equivalents of the features and concepts described herein.

Aspects of the invention further enable the efficient utilization of the elevator cab space in an area with huge passenger movement on the elevators. The invention provides better passenger experience with less waiting times. Moreover, the aspects of the present invention reduces number of hall calls for a particular elevator as the elevator accommodates more passengers each time. The invention reduces the maintenance and power consumption by the elevator due to lesser number of elevator movement by the virtue of efficient utilization of the space inside the elevator. The aspects of the invention allows the elevator system to provide possible rearrangement of the passengers and objects to improve the utilization of space inside the elevator cab.

Figure 1:
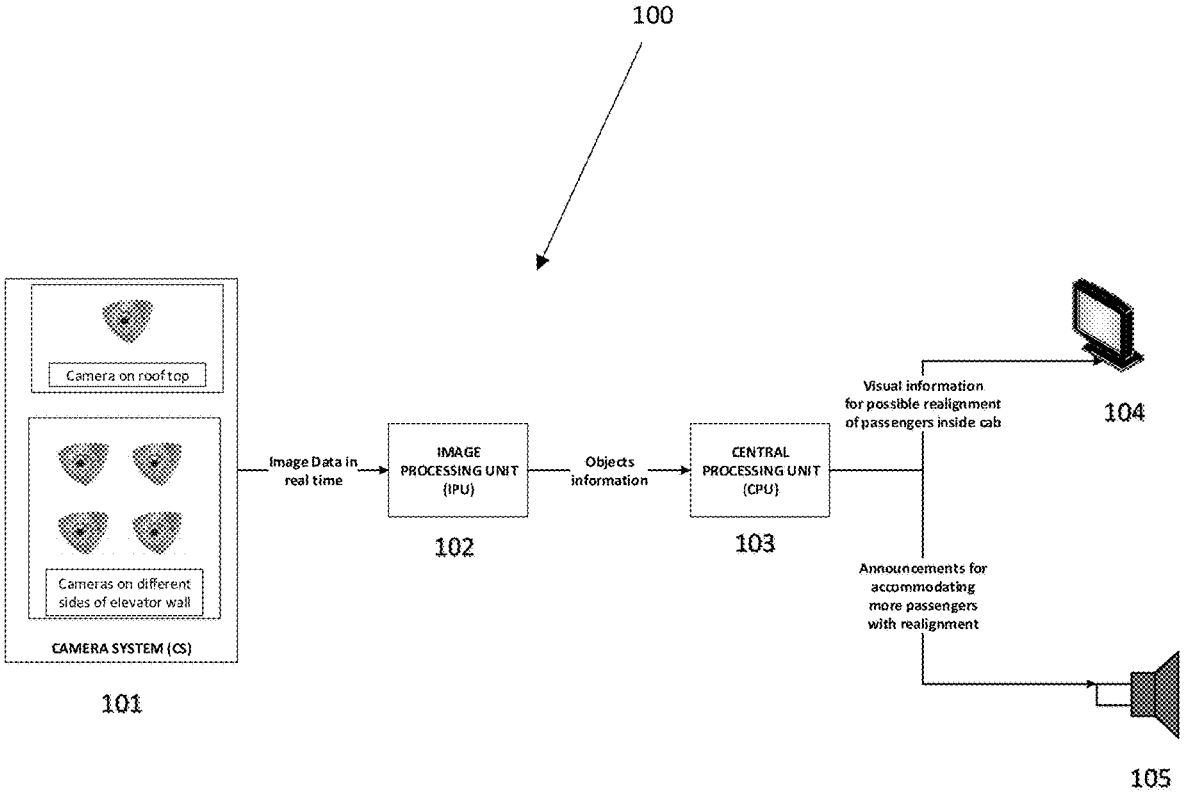
FIG. 1 is an exemplary block diagram illustrating a system for efficiently utilizing an elevator cab space.

Referring again to FIG. 1, an exemplary block diagram illustrates a system 100 for providing possible rearrangement of the occupants inside the elevator cab. The rearrangement enables efficient utilization of the space inside the elevator cab. In the example of FIG. 1, the system 100 associated with an elevator represents a system for providing possible rearrangement for passengers and objects to avoid longer queues and waiting time outside the elevator cab. The system includes a camera system 101 which is coupled to an image processing unit, IPU 102. The IPU 102 is further connected to a central processing unit, CPU 103. The CPU 103 is connected to a display unit 104 and an audio unit 105.

Figure 2:
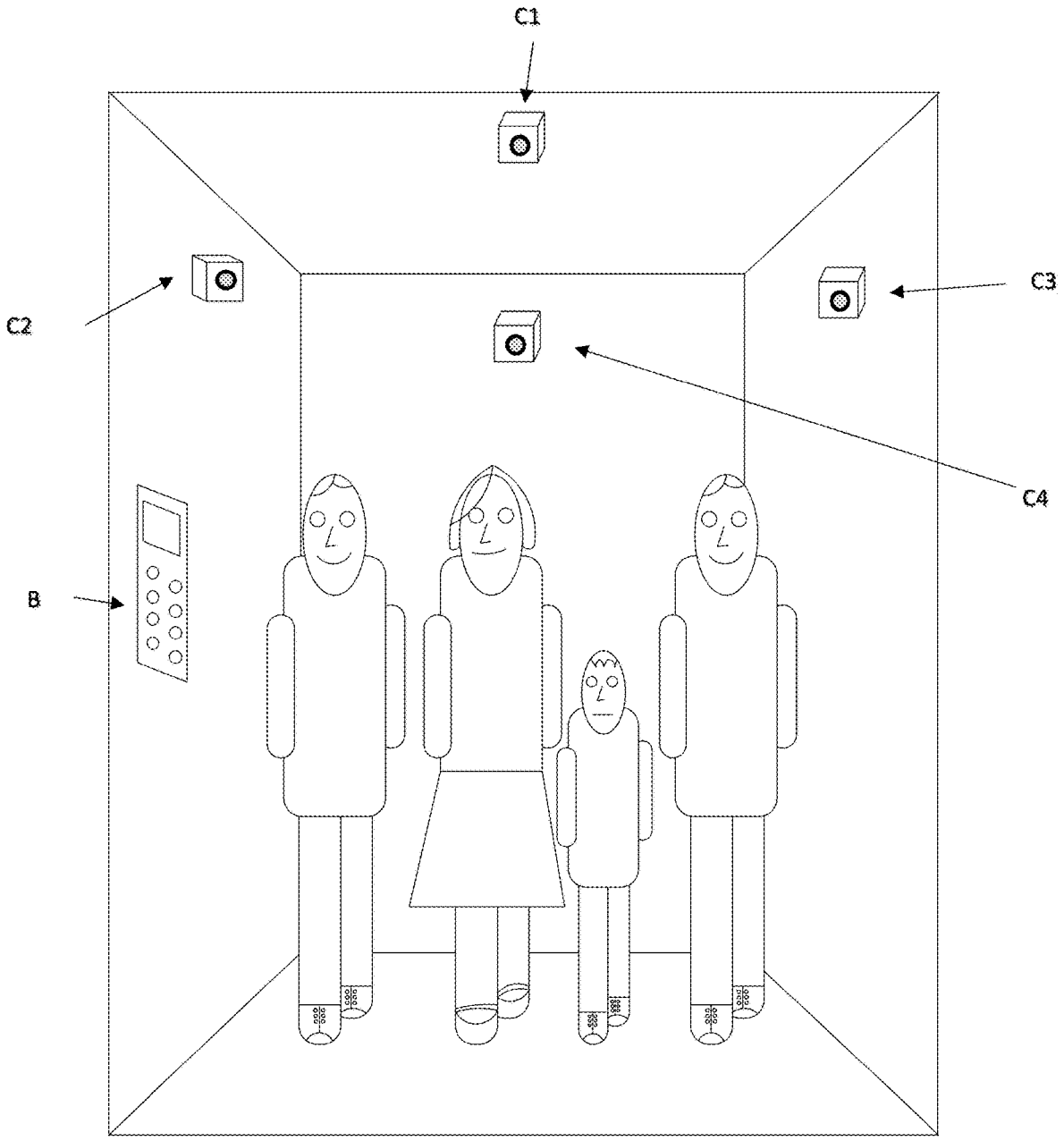
FIG. 2 is an exemplary image illustrating the elevator cab with camera system and passengers along with the objects.

FIG. 2 illustrates passengers inside the elevator cab and the camera system including a roof top camera C1, and different cameras C2, C3, C4 installed on different walls of the elevator. Further a floor button panel is available where floor buttons B indicating the floor level are provided with other buttons known in the art.

In the preferred embodiment of the invention, the camera system 101 is used to capture an image or sequence of images or a video stream. The camera system described in the invention encompasses all type of cameras known to person skilled in the art. The cameras used in the camera system can be a 3D camera, 2D camera or any other forms of cameras available. The camera system 101 includes at least one camera C1 mounted on the rooftop of the elevator cab. The camera system 101 may include a number of cameras C2, C3, C4 installed on different walls of the elevator to monitor the passengers and the objects. The different cameras C2, C3, C4 and the rooftop camera C1 can capture the image data and/or the video stream from inside the elevator cab. The image data and/or the video stream captured by the one or more cameras can be combined by the image processing techniques resulting in coherent image data. For the purposes of brevity the explanation of the image processing techniques is being omitted.

The camera system 101 is able to capture the image data inside the elevator cab as well as outside the elevator cab. The area outside the elevator cab is termed as Hall area and would be described later.

The image data captured by the camera system 101 is transmitted to an IPU 102. The IPU 102 processes the captured image data to indicate the available space and the space occupied by the passengers and objects inside the elevator cab. The IPU 102 determines position of each passenger and object inside the elevator in terms of Cartesian co-ordinates. It is be noted that the occupants inside the elevator cab can be other than passengers and objects and not merely limited to the occupants described herein. For clarity, the occupants are described as passengers and objects for exemplary purposes. The IPU also determines size of each passenger and object i.e. length, width, and area of each passenger and object. Further, the IPU 101 is also able to identify face of the passengers using face recognition techniques.

In another embodiment the IPU determines the relative position of each passenger and the object. By determining the relative position along with length, width, area of each passenger and object, the available space inside the elevator cab is determined. An exemplary image showing passengers and the objects is illustrated as FIG. 3.

Figure 3:
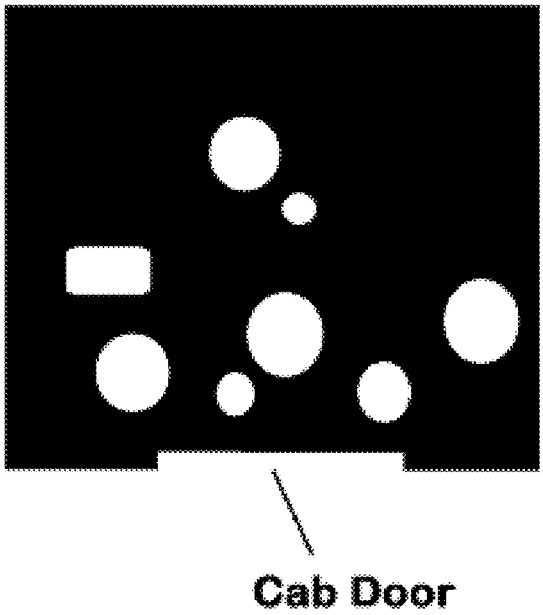
FIG. 3 is an exemplary image created by an image processing unit of the invention.

FIG. 3 illustrates the space inside the elevator cab. The black area represents the floor space and the white portions represents the occupied area like the passengers and the objects. The image as shown in FIG. 3 is used to determine the size of each objects and the passengers.

The IPU creates a mapping of each object and each passenger (each occupant), wherein the each object/passenger is represented by following features:

Unique ID (Id)
Relative position—(X, Y) coordinate inside cab
Length (L)
Width (W)
Radius (R)
Area (A)
Face recognition (F)

In another embodiment, the relative position can be in the form of (X, Y, Z) coordinate. Further, it is to be noted that the number of features determined by the IPU is not limited to the features mentioned above. It is to be noted that the face recognition by the camera system 101 can be, for example be used to track floor button B pressed by each passenger.

Figure 4:
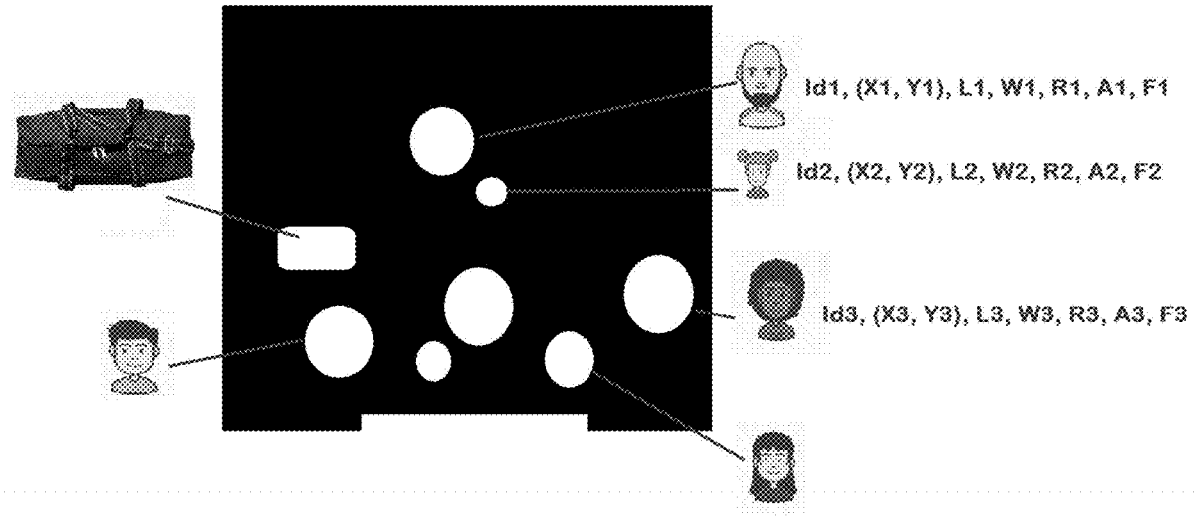
FIG. 4 is an exemplary image illustrating features of the passengers and objects determined by the image processing unit.
Figure 5:
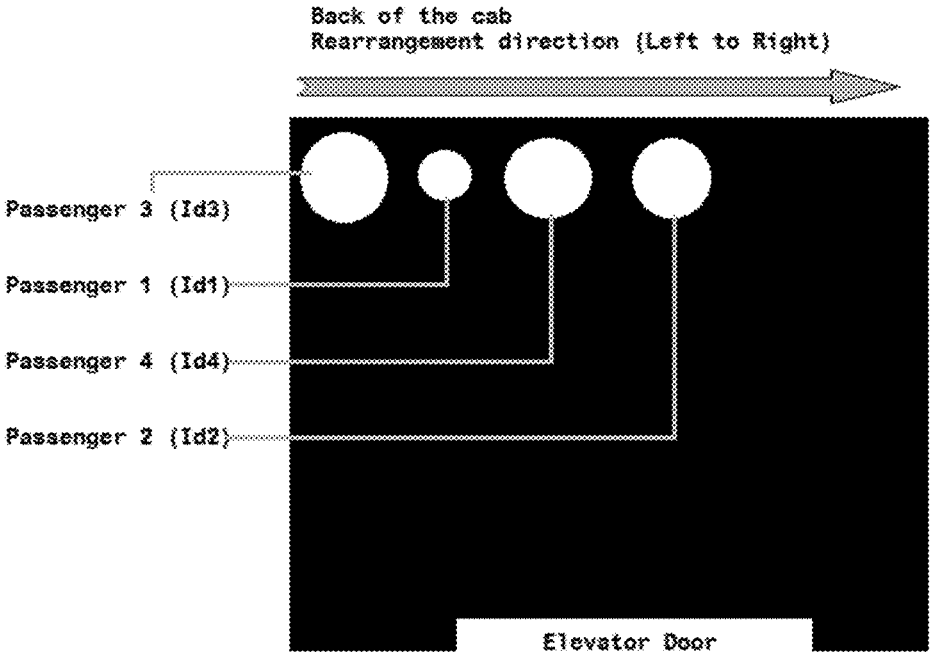
FIG. 5 is an exemplary image illustrating rearrangement of the passengers and objects as determined by the central processing unit.
Figure 6:
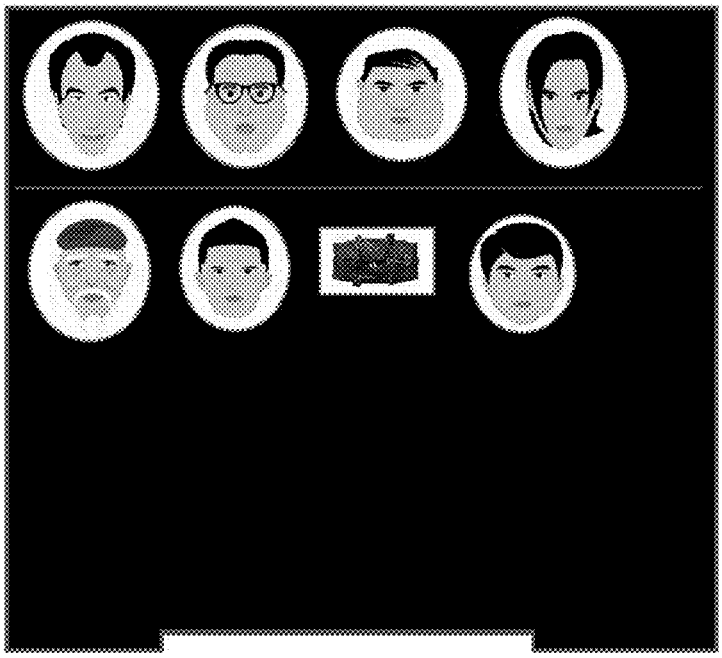
FIG. 6 is an exemplary image processed by central processing unit for display.

The mapping of each object/passenger with respect to features mentioned above is illustrated in FIG. 4. Each object/passenger has associated configuration in terms of position coordinates, length, width, radius, area etc. The mapped image as shown in FIG. 4 is called as a Cab Master image. The Cab Master image is input into the CPU 103 and Final image is created. The Final image thus formed, displays the possible rearrangement given the size, length, area of different objects and passengers (occupants). The images with rearranged passengers and objects is shown in FIG. 5 and FIG. 6.

It is to be noted that the rearrangement of the passengers and objects inside the elevator cab can be shown in a number of possible ways based on the intelligence inside the CPU 103. As an illustrative example, CPU 103 can find out an object (Idx) which occupies largest area (Ax) and arranges it at the back side (left to right). Similarly, all remaining objects are arranged from back to front in a row in same manner i.e. object with larger area are placed back.

As an example, the camera system 101 provides information about floor button B pressed by each passenger (Fx) to IPU 102. The IPU 102 creates features for each passenger with floor Number (FNx) as an additional parameter and sends it to the CPU 103. While rearranging passengers, the CPU checks the next floor to be arrived at and reorganize passengers such that passenger with highest floor (if cab is moving in up direction) or lowest floor (if cab is moving downside) will be placed at the back. In other words, if the elevator cab is currently at floor 3 with no passenger, Passenger 1 enters into cab and presses $15^{th}$ floor button and Passenger 2 enters and presses $7^{th}$ floor button. While cab is moving up, there is a hall call at floor 5 and passengers 3 & 4 enter. Passenger 3 presses floor number $20^{th}$ and passenger 4 presses floor number $8^{th}$. In this case, there would be four passengers with designating passengers as:

Passenger1: Id1, X1, Y1, L1, W1, R1, A1, F1, FN15
Passenger2: Id2, X2, Y2, L2, W2, R2, A2, F2, FN7
Passenger3: Id3, X3, Y3, L3, W3, R3, A3, F3, FN20
Passenger4: Id4, X4, Y4, L4, W4, R4, A4, F4, FN8

In this example, while rearranging, Id3 (F3) will be placed at back left side, next to it will be Id1 (F1), then Id4 and Id2. In this way, it makes sure passengers who are going to leave elevator in the end, will be arranged at the back first. FIG. 5 illustrates the exemplary rearrangement as discussed herein.

The arrangement and the rearrangement performed by the CPU is not limited by the example presented above. There can be numerous other ways for rearrangement with various permutations and combinations to accommodate more passengers which are within the scope of the invention.

The Final image generated after rearrangement provided by the CPU, as an example, can be as shown in FIG. 6. The Final image as an example can be based on the exemplary embodiment described above. The Final Image generated by the CPU is sent to a display unit 104. The display unit 104 can preferably be a liquid crystal display (LCD) display, but not limited specifically to the LCD display. The display unit displays the rearrangement which can be emulated by the occupants inside the elevator cab. In another embodiment, the final image is not limited to a static image like .jpeg. .jpg or .png type. As the same time it can be an animate type graphic e.g. .gif which shows movement of occupants as well. In yet another embodiment the CPU can send the video to emulate the possible rearrangement on the display.

In another embodiment, while doors are opening, the camera system scans the hall area and provides this information to the IPU. As discussed above, similar to the generation of Cab Master Image, the IPU processes image data of the Hall area and creates similar Hall Master Image with features of passengers/objects waiting in hall area. The Hall Master image is provided to the CPU for processing.

The CPU analyzes the cab master image generated for the passengers and objects (occupants) inside the elevator cab with the Hall Master Image as described above. Based on the analysis the CPU provides instructions to announce the rearrangement on a speaker and provide information about how may more passengers can be accommodated in the elevator cab. As an example, the analysis of the Hall master image is done so as to accommodate maximum number of occupants inside the elevator cab.

In yet another embodiment the system 100 described in the instant invention can be a single device or module including the camera(s), Image Processing Unit, and a CPU. The embodiments and examples as described are applicable in such a device.

The CPU represents any device executing instructions (e.g., as application programs, operating system functionality, or both) to implement the operations and functionality associated with the CPU.

In some examples, the CPU has at least one input port, processor, a memory area, and an output port. The processor includes any quantity of processing units, and is programmed to execute computer-executable instructions for implementing aspects of the invention. The instructions may be performed by the processor or by multiple processors executing within the CPU.

In some examples, the processor represents an implementation of analog techniques to perform the operations described herein. For example, the operations may be performed by an analog CPU and/or a digital CPU.

The CPU further has one or more computer readable media such as the memory area. The memory area includes any quantity of media associated with or accessible by the CPU. The memory area may be internal to the CPU, or external to the CPU, or both. In some examples, the memory area includes read-only memory and/or memory wired into an analog CPU.

Figure 7:
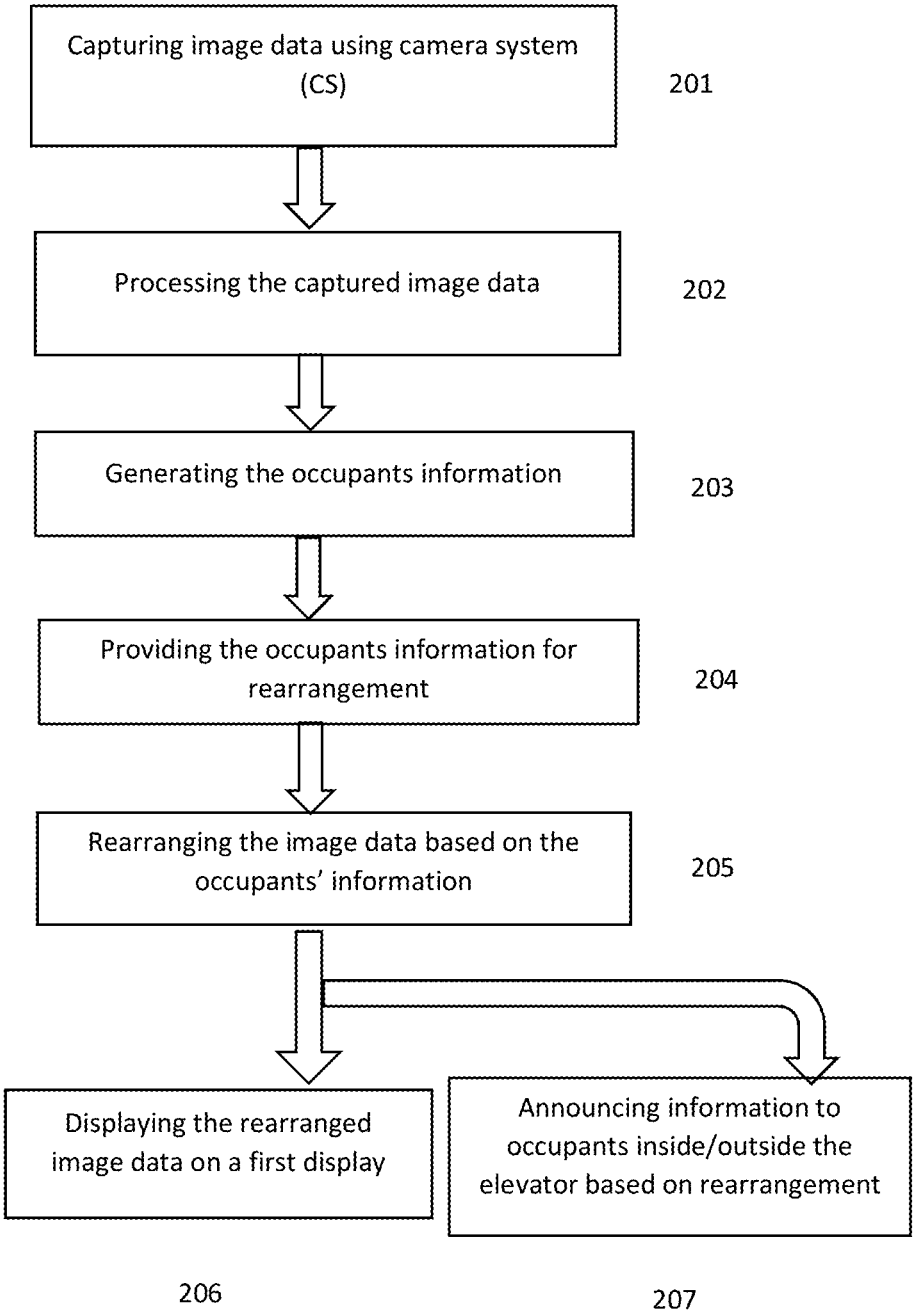
FIG. 7 is an exemplary flowchart indicating the operations performed by the inventive system.

FIG. 7 illustrates a flowchart of the actions performed by the system 100 provided in FIG. 1. The system 100 captures image data using the camera system (201). The captured image data is provided to the IPU. The IPU processes the image data to identify available space and occupied space inside the elevator cab (202). The image is processed and occupants information is determined (203). The position and objects information include determining the relative position of each passenger and object (occupant) inside the elevator cab in terms of Cartesian coordinates (X, Y, Z). The passenger and object information further includes determining length, radius, width, area, facial recognition for each passenger and object inside the elevator cab. The passenger and object information of each passenger is provided to the CPU (204). The CPU analyzes the passenger and object information to determine the possible rearrangement of the passengers and objects (205). The rearranged information of passengers and objects is displayed on a first display unit (preferably LCD) (206). The CPU also sends the information to an audio unit to announce information related to rearrangement and possibility to accommodate more occupants (207).

In another embodiment, the image processing unit determines the passenger and object information by processing the image data. The passenger and object information includes facial recognition of each passenger inside the elevator and relative position of each passenger and object inside the elevator in terms of Cartesian coordinates (X, Y, Z). The passenger and object information further includes the length, width, radius and area occupied by each passenger and object.

The image processing unit provides a cab master image to the CPU along with passenger and object information. The CPU determines the rearrangement of the passengers and objects based on the passenger and object information. In another embodiment, the rearrangement of the passengers is based on the destination floor of the passengers.

In yet another embodiment, image data of the passengers and objects waiting outside the elevator is captured and a hall master image is created for display. The hall master image is analyzed with the cab master image to determine the rearrangement inside the elevator. Further, the information regarding accommodation of more passengers inside the elevator cab is also announced. As an example, the rearrangement is made to accommodate maximum occupants inside the elevator cab.

In some examples, the operations illustrated in FIG. 7 may be implemented as software instructions encoded on a computer readable medium, in hardware programmed or designed to perform the operations, or both. For example, aspects of the invention may be implemented as a system on a chip or other circuitry including a plurality of interconnected, electrically conductive elements.

While the aspects of the invention have been described in terms of various examples with their associated operations, a person skilled in the art would appreciate that a combination of operations from any number of different examples is also within scope of the aspects of the invention.

Exemplary computer readable media include flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures and described herein. Other examples of the invention may include different computer-executable instructions or components having more or less functionality than illustrated and described herein.

Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. An elevator system for managing space inside an elevator, said system comprising:

a camera system for acquiring image data of occupants inside the elevator;

an image processing unit to process the image data acquired by the camera system to generate information related to each of the occupants;

a processing unit receiving the information related to each of the occupants and rearranging the image data based on the information; and a first display unit to display the rearrangement of the occupants provided by the processing unit, wherein:

the occupants' information is the information related to occupants' size and input floor destination and objects inside the elevator, wherein information related to the occupants' size includes the length, width, radius and area occupied by each occupant;

the image processing unit: determines total available space and occupied space inside the elevator; and processes the occupant information to determine relative position of each occupant inside the elevator; and the rearrangement of the occupants displayed on the first display unit is based on the occupied by each occupant inside the elevator and the destination floor input by each occupant.

2. The system as claimed in claim 1, wherein the camera system includes one or more cameras to acquire the image data.

3. The system as claimed in claim 2, wherein the one or more cameras are 3D cameras.

4. The system as claimed in claim 2, wherein at least one of the cameras is mounted on rooftop of the elevator.

5. The system as claimed in claim 2, wherein one or more cameras are placed on different walls of the elevator.

6. The system as claimed in claim 1, wherein the image processing unit processes the occupants information including facial recognition of each passenger inside the elevator.

7. The system as claimed in claim 1, wherein the relative position of each occupant in the elevator is processed in terms of X, Y, Z coordinates.

8. The system as claimed in claim 1, wherein the image processing unit provides a cab master image to the processing unit.

9. The system as claimed in claim 1, wherein the rearrangement of the occupants displayed on the first display unit is a video stream showing rearrangement of the occupants inside the elevator.

10. An elevator system for managing space inside an elevator, said system comprising:

a camera system for acquiring first image data of occupants inside the elevator and a second image data of passengers waiting outside the elevator in a hall area;

an image processing unit to process the first image data to generate first information related to each of the occupants and creating a cab master image and to generate a second information related to the passengers in the hall area and creating a hall master image;

a processing unit receiving the cab master image and the hall master image from the image processing unit and rearranging the image data based on the cab master image and the hall master image to accommodate passengers in the hall area; and an audio unit receiving information from the processing unit based on rearranged image data to announce the accommodation of passengers from the hall area, wherein:

the occupants' information is the information related to occupants' size and input floor destination and objects inside the elevator, wherein information related to the occupants' size includes the length, width, radius and area occupied by each occupant;

the image processing unit: determines total available space and occupied space inside the elevator; and processes the occupant information to determine relative position of each occupant inside the elevator; and the rearrangement of the occupants displayed on the first display unit is based on the occupied by each occupant inside the elevator and the destination floor input by each occupant.

11. The system as claimed in claim 10, wherein the audio unit announcing the number of passengers in the hall area that can be accommodated inside the elevator.

12. A method for efficiently managing space inside an elevator, said method comprising:

acquiring image data of occupants inside the elevator;

processing the acquired image data and generating information related to each of the occupants;

receiving the occupant information related to each of the occupants and rearranging the image data based on the occupants' information; and displaying the rearranged data of the occupants inside the elevator, wherein:

the occupants' information is the information related to occupants' size and input floor destination and objects inside the elevator, wherein information related to the occupants' size includes the length, width, radius and area occupied by each occupant;

the image processing unit: determines total available space and occupied space inside the elevator; and processes the occupant information to determine relative position of each occupant inside the elevator; and the rearrangement of the occupants displayed on the first display unit is based on the occupied by each occupant inside the elevator and the destination floor input by each.

13. The method as claimed in claim 12, wherein the occupants' information include facial recognition, relative position, length, width, radius, and area of each passenger.

14. The method as claimed in claim 12, wherein the occupants' information is used to generate a cab master image.

* * * * *